US011661817B2

(12) United States Patent
Agour

(10) Patent No.: US 11,661,817 B2
(45) Date of Patent: May 30, 2023

(54) ALTERNATIVE CASING CEMENTING TOOL AND METHODS THEREOF

(71) Applicant: Saudi Arabian Oil Company, Dhahran (SA)

(72) Inventor: NourEldeen Nabil Abdelaziz Agour, Elbagour (EG)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 69 days.

(21) Appl. No.: 17/242,825

(22) Filed: Apr. 28, 2021

(65) Prior Publication Data

US 2022/0349274 A1 Nov. 3, 2022

(51) Int. Cl.
*E21B 33/16* (2006.01)
*E21B 33/12* (2006.01)

(52) U.S. Cl.
CPC ..... *E21B 33/16* (2013.01); *E21B 33/1204* (2013.01)

(58) Field of Classification Search
CPC ..... E21B 33/13; E21B 33/14; E21B 33/146; E21B 33/16; E21B 33/165
See application file for complete search history.

(56) References Cited

U.S. PATENT DOCUMENTS 2,161,283 A * 6/1939 Crowell ..... E21B 33/14 166/155
2,502,886 A * 4/1950 Ragan ..... E21B 33/14 137/533.15
2,811,208 A * 10/1957 Eadie ..... E21B 21/10 166/222
6,401,824 B1 6/2002 Musselwhite et al.
8,167,312 B2 5/2012 Adamek
9,359,865 B2 6/2016 Mailand et al.
9,982,493 B2 5/2018 Loviknes et al.
2004/0084182 A1 5/2004 Edgar et al.
2010/0051278 A1* 3/2010 Mytopher ..... E21B 43/116 166/298
2017/0167225 A1* 6/2017 Mericas ..... E21B 21/10

OTHER PUBLICATIONS

Weatherford "Well Construction: Casing Accessories", 2016. 56 pages.

(Continued)

*Primary Examiner* — David Carroll
(74) *Attorney, Agent, or Firm* — Leason Ellis LLP

(57) ABSTRACT

A cementing tool and a method for cementing a casing string using the cementing tool is provided. The cementing tool comprises threaded top and bottom openings for attaching to a casing string, a plurality of ports, and a plurality of shear plugs shaped to fit within the ports. In the method, a casing string comprising the cementing tool is run into a well and the cementing process of the casing string is initiated. When the casing shoe of the casing string becomes plugged, the cementing tool is activated without removing the casing string from the well. Activation of the cementing tool releases pressure trapped in the cementing tool, thereby releasing the shear plugs from the ports and opening the ports to create alternative passages for the cement to complete the cementing process.

13 Claims, 5 Drawing Sheets

(56) References Cited

OTHER PUBLICATIONS

Newberry, Jack et al,. "Port collar adds flexibility to cementing and selective completions." Petroleum Engineer International 72.6 (1999).
No Author. "API Coupling and Threads for Casing & Tubing (OCTG Coupling)." Octalsteel, www.octalsteel.com/api-coupling-and-threads. 12 pages.
Forum Energy Technologies, "Cementing & Casing Accessories Davis-Lynch Equipment Catalog". 19 pages.

* cited by examiner

ALTERNATIVE CASING CEMENTING TOOL AND METHODS THEREOF

TECHNICAL FIELD

The present disclosure is generally related to methods for cementing a casing string in a well.

BACKGROUND

To prepare a well for drilling, a casing string is lower into the wellbore and cemented in place, thereby stabilizing the wellbore. During the cementing process, the casing shoe of the casing string can sometimes become plugged, thereby preventing the completion of the cementing process. Conventionally, the casing string must be pulled back to the surface of the well and the wellbore has to be conditioned before the cementing process can be continued. Additionally, any damage to the accessories of the casing (e.g., casing shoe, casing collar) must be replaced before the casing string is delivered back into the wellbore. These additional steps of pulling up the casing to the surface, conditioning the wellbore, and replacing damaged accessories result in delays in the completion of the cementing process and can be very costly.

The present application addresses these and other challenges related to cementing a casing string in a well.

SUMMARY

According to a first aspect, a method for cementing a casing string in a well is provided. The casing string comprises a casing shoe, a float collar, and a cementing tool. The cementing tool includes a plurality of ports arranged in a circumferential pattern on a surface of the cementing tool and a plurality of shear plugs each shaped to fit within one of the plurality of ports. In the method, the casing string with the cementing tool is run down into the well. A cementing process of the casing string is then initiated in which cement is released down the casing string, wherein during the cementing process, the casing shoe becomes plugged. The cementing tool is then activated without removing the casing string from the well. Activation of the cementing tool releases pressure trapped at a predetermined level in the cementing tool, thereby releasing the shear plugs from the ports and opening the ports to create alternative passages for the cement. The cementing process of the casing string is then completed using the alternative passages created by the cementing tool.

In another aspect, the step of activating the cementing tool comprises applying pressure in the casing string via a surface pumping unit, wherein the application of pressure causes a buildup of pressure in the cementing tool, which causes the shear plugs of the cementing tool to be released.

In another aspect, the trapped pressure of the cementing tool upon activation does not exceed 60% of a casing burst value. In a further aspect, the trapped pressure of the cementing tool upon activation does not exceed 5000 psi.

In another aspect, the cementing tool is attached to the casing string at a location adjacent and below a float collar of the casing string.

In another aspect, the cementing tool is fabricated as part of a float collar of the casing string.

In a second aspect, a method for cementing a casing string installed in a well is a provided. The casing string comprising a casing shoe, a float collar, and a cementing tool. The cementing tool comprises a plurality of ports arranged in a circumferential pattern on a surface of the cementing tool and a plurality of shear plugs each shaped to fit within one of the plurality of ports. In the method, cementing of the casing string is initiated by pouring cement slurry into the casing string. Next, it is then determined whether the casing shoe has become plugged. If the casing shoe has been plugged, the cementing tool is activated. The cementing tool is activated without removing the casing string from the well, and activation of the cementing tool releases pressure trapped at a predetermined level in the cementing tool, thereby releasing the shear plugs from the ports and opening the ports to create alternative passages for the cement. The cementing process of the casing string is then completed using the alternative passages created by the cementing tool.

In another aspect, an opening pressure of the cementing tool upon activation does not exceed 60% of a casing burst value. In another aspect, the cementing tool is attached to the casing string at a location adjacent and below a float collar of the casing string or fabricated as part of the float collar.

In another aspect, the step of activating the cementing tool comprises applying pressure in the casing string via a surface pumping unit, wherein the application of pressure causes a buildup of pressure in the cementing tool, which causes the shear plugs of the cementing tool to be released In a third aspect, a cementing tool for completing cementing of a casing string when a casing shoe of the casing string becomes plugged is provided. The cementing tool is generally cylindrical in shape. The cementing tool includes a top opening at a proximal end of the cementing tool, where the top opening has a threaded portion on an inner or outer surface of the proximal end. The cementing tool also includes a bottom opening at a distal end of the cementing tool, where the bottom opening has a threaded portion on an inner or outer surface of the distal end, and where at least one of the threaded portions of the top opening and the threaded portion of the bottom opening is configured to securely attach to the casing string. The cementing tool further includes a plurality of ports arranged in a circumferential pattern on the cementing tool, and a plurality of shear plugs each shaped to fit within one of the plurality of ports. The shear plugs are configured to release from the ports upon activation of the cementing tool, thereby creating alternative passages for cement to pass to complete the cementing of the casing string.

In another aspect, the cementing tool is made of the same grade of material or a higher grade of material as the casing string. In another aspect, the threaded portion of the top opening is on the inner surface of the proximal end and wherein the threaded portion the bottom opening on the outer surface of the distal end.

In another aspect, the threaded portion of the top opening and the threaded portion of the bottom opening are manufactured from drillable material. In a further aspect, the drillable material is brass or copper. In another aspect, the shear plugs comprise an aluminum and copper alloy. In another aspect, the cementing tool is fabricated as part of a float collar of the casing string.

In another aspect, the cementing tool further includes: a spring with a ball head, a concrete profile configured to hold the spring with the ball head, and a locking profile located above the spring with the ball head. The spring with the ball head, the concrete profile, and the locking profile are located between the top opening and the bottom opening. In a further aspect, the spring with the ball head is configured to prevents flowback of the cement slurry during cementing of the casing string. In a further aspect, the spring with the ball head, the concrete profile, and the locking profile are located above the plurality of ports.

BRIEF DESCRIPTION OF THE DRAWING FIGURES

DETAILED DESCRIPTION OF CERTAIN EMBODIMENTS

By way of overview and introduction, the present application discloses an apparatus and methods for cementing a casing string in a well when a plug in the casing shoe of the casing is encountered. In the methods of the present application, the casing string comprising a casing shoe, a float collar, and a cementing tool attached to a distal end of the casing string. The cementing tool is generally cylindrical in shape and includes a plurality of ports arranged circumferentially on its surface and a plurality of shear plugs shaped to fit in the ports. In the method, in accordance with one or more embodiments, the casing string comprising the cementing tool is run down into the well and a cementing process of the casing string is initiated. In an instance in which the casing shoe becomes plugged during the cementing process, the cementing tool is activated without removing the casing string from the well. Activation of the cementing tool creates an alternative passage for the cement to pass, thereby bypassing the plugged casing shoe. Using the created alternative passage, the cementing process of the casing string is then completed.

These and other aspects of the present apparatus and methods are described in further detail below with reference to the accompanied drawing figures, in which one or more illustrated embodiments and/or arrangements of the apparatus and methods are shown. The apparatus and methods of the present application are not limited in any way to the illustrated embodiment and/or arrangement. It should be understood that the apparatus and methods as shown in the accompanying figures are merely exemplary of the apparatus and methods of the present application, which can be embodied in various forms as appreciated by one skilled in the art. Therefore, it is to be understood that any structural and functional details disclosed herein are not to be interpreted as limiting the present apparatus and methods, but rather are provided as a representative embodiment and/or arrangement for teaching one skilled in the art one or more ways to implement the present apparatus and methods. It should be understood that, as used in the present application, the term "approximately" when used in conjunction with a number refers to any number within 5% of the referenced number, including the referenced number.

Figure 1A:
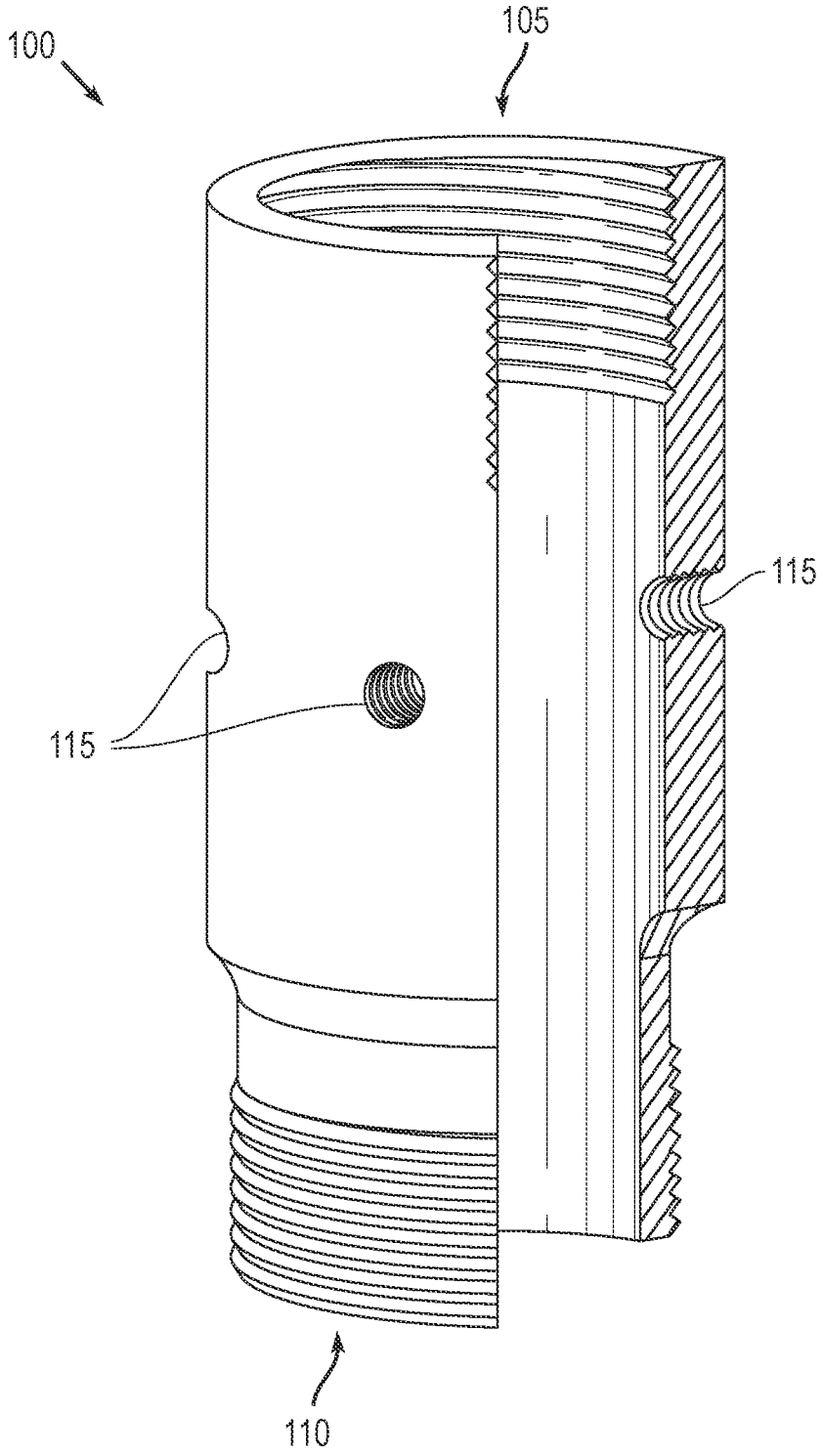
FIGS. 1A-1B show a quarter cut, cross-sectional view (FIG. 1A) and a side view (FIG. 1B) of an exemplary cementing tool for attachment to the casing string in accordance with one or more embodiments.
Figure 1B:
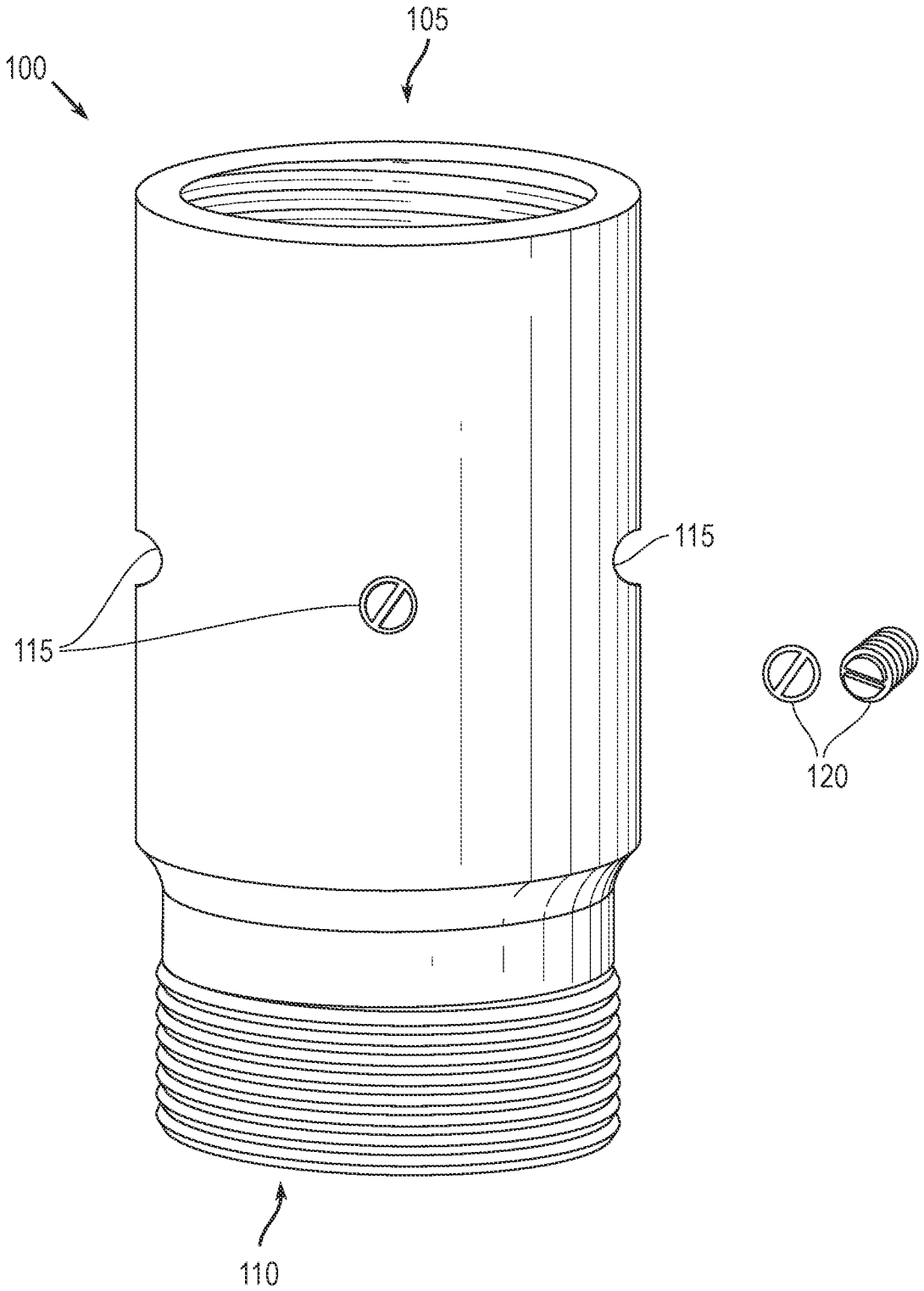
Figure 1C:
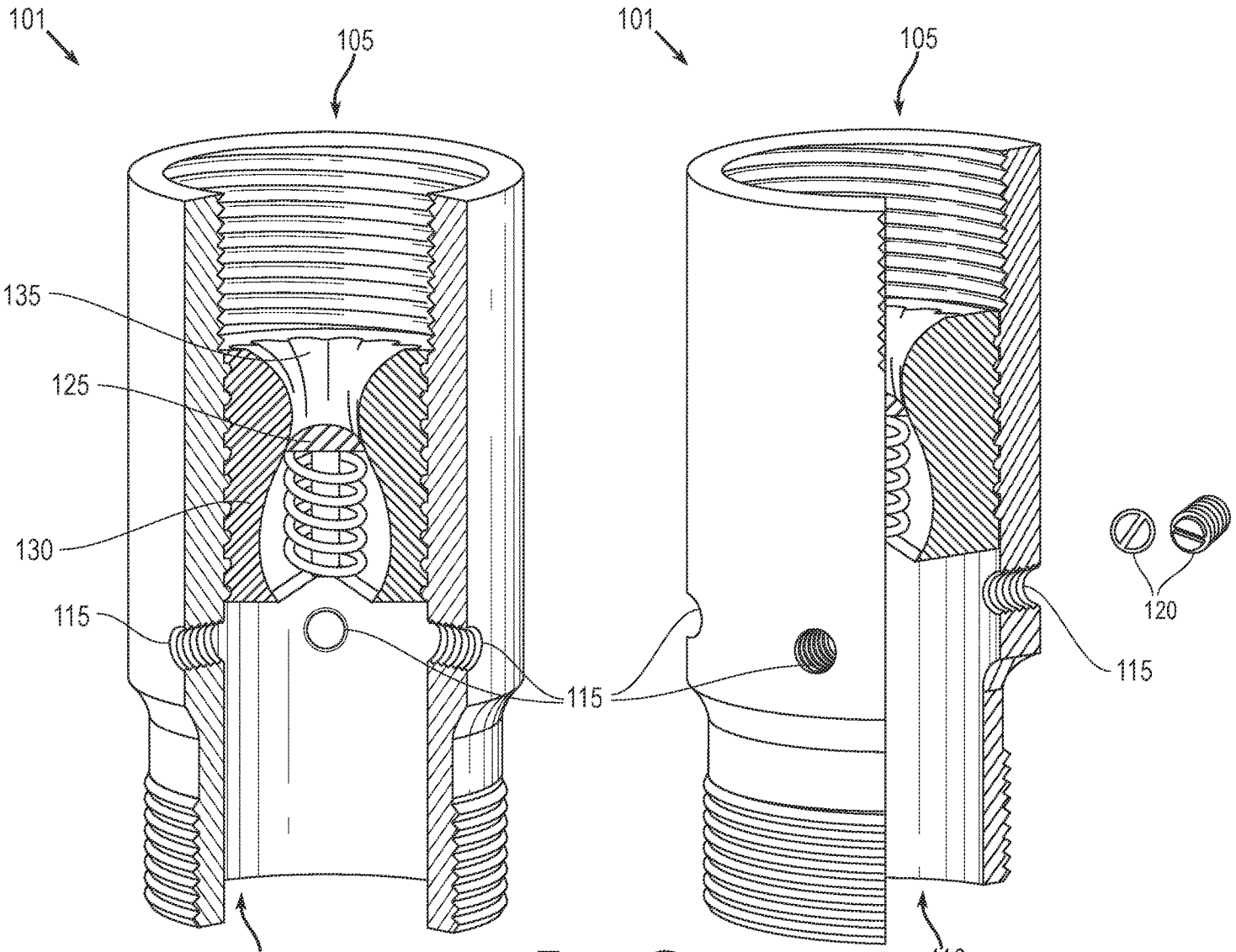
FIG. 1C shows a half cut, cross-sectional view of an exemplary cementing tool having a spring with a ball head for attachment to the casing string in accordance with one or more embodiments.

FIGS. 1A-1B show various views of an exemplary cementing tool 100 for attachment to a casing string in accordance with one or more embodiments. FIG. 1C shows another embodiment of the cementing tool 101, as discussed in further detail below. As shown in FIGS. 1A-1B, the cementing tool 100 is generally cylindrical in shape. The cementing tool 100 is sized and shaped to securely connect to a portion of a casing string. As shown in the exemplary embodiments of FIGS. 1A-1B, the cementing tool 100 includes a top opening 105 and a bottom opening 110. In one or more embodiments, each of the top opening 105 (at the proximal end) and bottom opening 110 (at the distal end) are threaded openings that are sized and shaped to securely connect to the casing string. For instance, a bottom portion of the casing string can have threading that matches the threading of the bottom opening 110 such that threading of one of the bottom opening 110 screws into the threading of the casing string, thereby securely connecting the cementing tool 100 to the casing string. In one or more embodiments, the top opening 105 and bottom opening 110 (threaded openings) are made of drillable material, such as brass or copper, for example. In one or more embodiments, the cementing tool 100 is made from the same grade of material as the casing string it is attached to or a higher grade of material than the casing string.

The threading of the top opening 105 and the bottom opening 110 can be located on an outer surface of the cementing tool 100 or an inner surface of the cementing tool. For example, as shown in FIGS. 1A-1B, the threading of the top opening 105 is located on an inner surface of the top opening 105 and the threading of the bottom opening 110 is located on an outer surface of the bottom opening 110.

In one or more embodiments, the threading of the top opening 105 or the threading of the bottom opening 110 is configured to securely attach to a float collar of the casing string. In one or more embodiments, the cementing tool 100 is configured to attach to the casing string at a location adjacent and/or below a float collar of the casing string. In at least one embodiment, the cementing tool 100 is fabricated as part of a float collar of the casing string.

With continued reference to FIGS. 1A-1B, the cementing tool 100 further comprises a plurality of ports 115 arranged in a circumferential pattern on the cementing tool 100. The number of ports 115 can vary based on numerous factors, including the circumference of the casing string, the circumference of the cementing tool 100, and the casing body thickness.

The number of ports can also be varied based on the pressure needed to get the proper turbulent flow effect for cement while pumping. In at least one embodiment, the maximum port diameter is 0.5 inches and the number of ports is 4 or more to achieve a desired pumping rate and displacement rate for the cement slurry, which is important for the cementing process as the thickening time for a surface cementing job is limited. Achieving the proper turbulent flow effect for cement using the cementing tool 100 results in a uniform cementing job after the casing shoe has plugged.

The cementing tool 100 also comprises a plurality of shear plugs 120 sized and shaped to securely fit within the plurality of ports 115. In one or more embodiments, the shear plugs 120 are screws and the ports 115 include threading matching those of the screws such that the screws securely fit within the ports 115. In one or more embodiments, the shear plugs 120 are fabricated from an aluminum and copper alloy, for example. However, it should be understood that the shear plugs can also be made of other metals or alloys appropriate for casing strings as is known and understood in the art.

FIG. 1C shows another embodiment of the exemplary cementing tool for attachment to a casing string in accordance with one or more embodiments. In this embodiment, the cementing tool 101 includes the aspects shown in the cementing tool 100 exemplified in FIGS. 1A-1B (e.g., the top opening 105, bottom opening 110, ports 115, and shear plugs 120), as well as further aspects, including a spring with a ball head 125, a concrete profile 130, and a locking profile 135, which are located between the top opening 105 and the bottom opening 110. In one or more embodiments, as shown in FIG. 1C, the spring with the ball head 125, the concrete profile 130, and the locking profile 135 are located above the ports 115. In the cementing tool 101, as exemplified in FIG. 1C, the spring with a ball head 125 acts as the float collar (i.e., prevents flowback of the cement slurry). As such, in this embodiment, because the cementing tool 101 encompasses a float collar (the spring with the ball head 125), a casing string with the cementing tool 101 attached to it does not have a separate float collar. The concrete profile 130 is configured to hold the spring with a ball head 125 within the cementing tool 101. The locking profile 135 is located above the spring with the ball head 125 and configured to hold a displacement plug when it lands within this portion of the cementing tool 101 that includes the float collar (i.e., the spring with a ball head 125).

Figure 2:
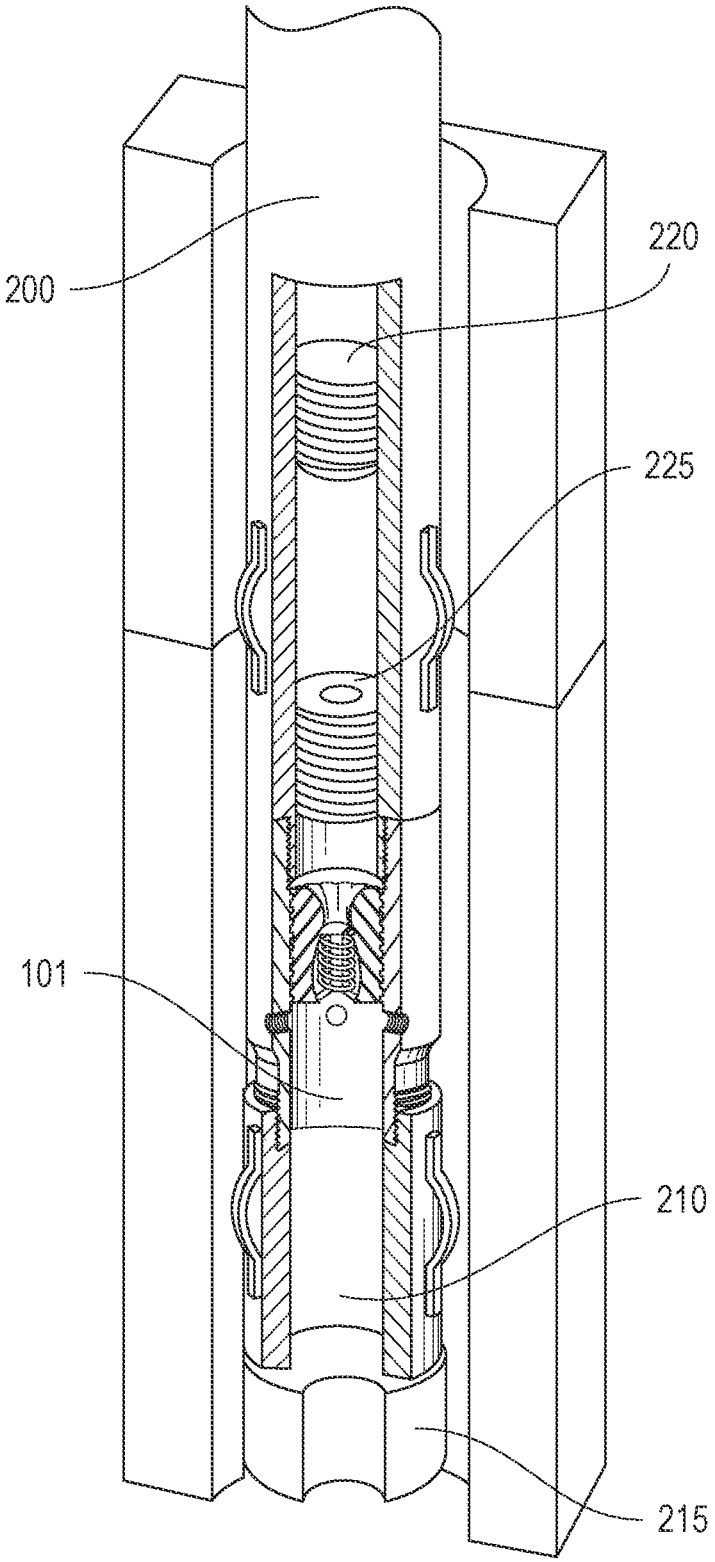
FIG. 2 shows a diagram of an exemplary casing string in a wellbore, where the exemplary casing string 200 includes the cementing tool in accordance with one or more embodiments.

FIG. 2 shows a diagram of an exemplary casing string 200 in wellbore, where the exemplary casing string 200 includes the cementing tool 101 of the present application, which also acts as a float collar as described above. The casing string further comprises a shoe track 210 and a casing shoe 215. Using the cementing tool 101 (or cementing tool 100) in the casing string 200 ensures that the float collar, the shoe track 210, and the casing shoe 215 will not have to be replaced if the casing shoe becomes plugged, as discussed in further detail below. When connected to the casing string 200, the cementing tool 101 also acts as a coupling device of the casing string 200 comprising a valve that allows fluid (e.g., cement slurry) to flow downward through the casing string, but prevents upward flow. The casing string can also include a top cementing plug 220 and a bottom cementing plug 225. The top and bottom cementing plugs are located in an upper portion of the casing string and prevent the cement slurry from mixing with other fluids in the wellbore. The bottom cementing plug 225 can include a diaphragm that selectively breaks to allow the cement slurry to flow downwardly through the cementing plug 225.

While FIG. 2 shows the cementing tool 101 attached to the casing string, it should be understood that, in one or more embodiments, the cementing tool 100 of the present application can attached to a casing string in a similar manner as shown for cementing tool 101. In particular, in one or more embodiments, the cementing tool 100 attaches to the casing string at a location adjacent to and/or below a separate float collar of the casing string. In such an embodiment, the casing string can further comprise a casing shoe and a shoe track. The shoe track is a portion of the casing located between the float collar and the casing shoe, which is located at the bottom end of the casing string. The casing shoe helps to prevent reverse flow of cement slurry from the annulus (i.e., the space between the wellbore and the casing string 200) into the casing string 200. In at least one embodiment, the cementing tool 100 is fabricated as part of the float collar of the casing string 200.

Figure 3:
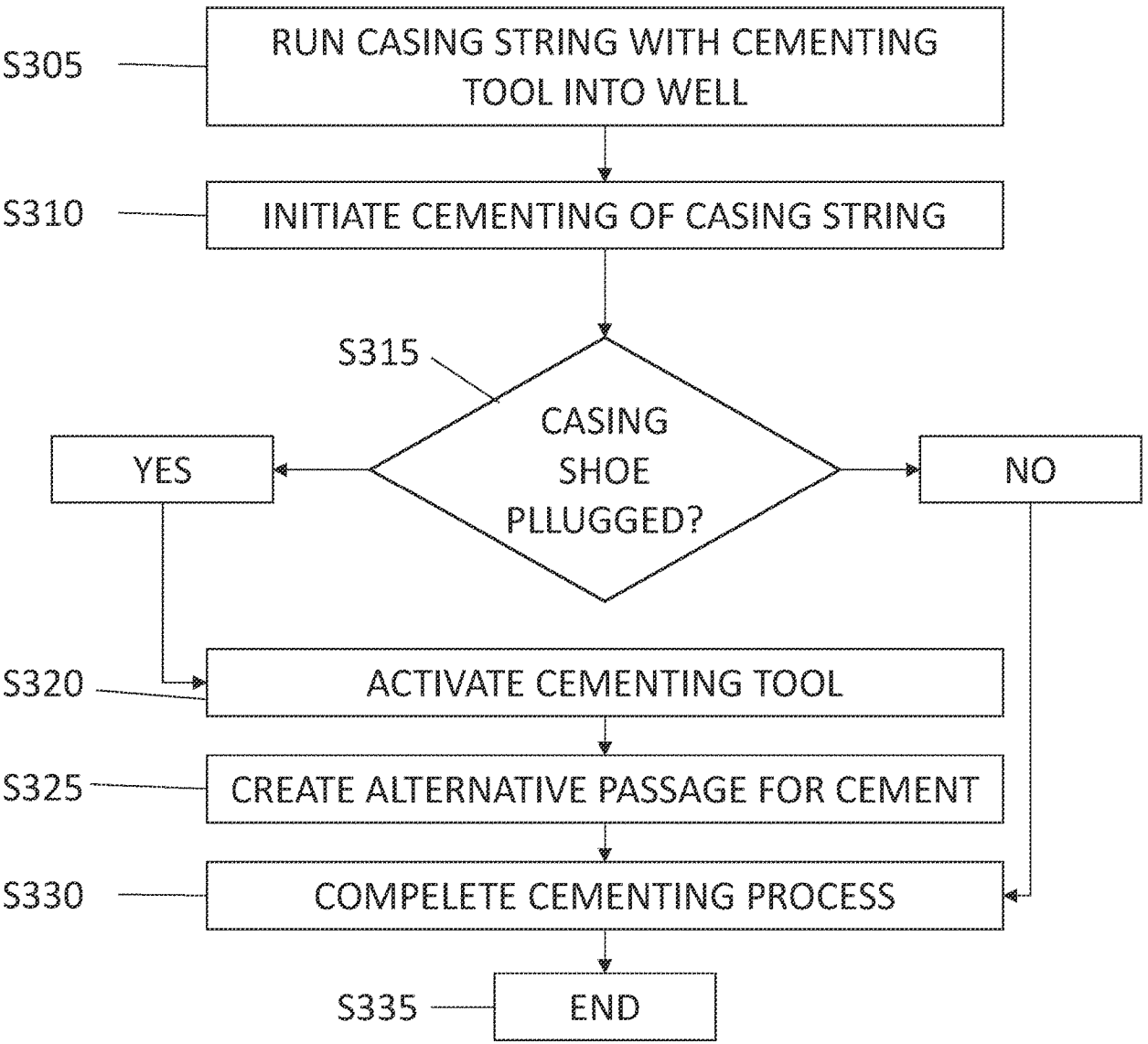
FIG. 3 shows a flow diagram of an exemplary method for cementing a casing string in a wellbore in accordance with one or more embodiments.

As discussed above, the cementing tool 100/101 of the present application is utilized in methods for cementing a casing string installed in a well when a plug in the casing shoe of the casing is expected or experienced in accordance with one or more embodiments. The cementing tool can be added just below the float collar sub or combined as part of a lower portion of the float collar. In embodiments in which the cementing tool is a part of a lower portion of the float collar, a float collar valve maintains the differential pressure that is added when cement slurry become in place in the annulus. FIG. 3 shows a flow diagram of an exemplary method for cementing a casing string installed in a well in accordance with one or more embodiments, for example in instances in which a remedial cementing operation is needed in a casing string that is experience thief zones.

With reference to FIG. 3 and with continued reference to FIGS. 1A-1C, the method begins at step S305, where a casing string that includes the cementing tool 100/101 is run through a surface hole of the well and down into the wellbore. The size (outside diameter) of the casing string can vary based on the size of the wellbore. For example, in one or more embodiments, the casing string used in the present method can include large casing strings, such as those having a size (outer diameter) of 9 and ⅝ths inches, 13 and ⅜ths inches, 18 and ⅝ths inches, or 20 inches, for example. The length of the casing can also vary depending of the depth of the wellbore. For example, in one or more embodiments, the length of the casing string can be approximately 40 feet or longer. In one or more embodiments, the well that the casing string is run down is a deviated well.

At step S310, cementing of the casing string in the wellbore is initiated. The initial cementing of the casing string can be carried out in a conventional manner as is known and understood in the art. In short, cement, water, and sometimes additives are combined to form a cement slurry, and the cement slurry is pumped down through the casing to areas in the wellbore around the casing string and/or in the open hole below the casing string.

As mentioned previously, during the cementing process, the casing shoe of the casing string can sometimes become plugged. For example, during the cementing of the casing string, the casing shoe can become plugged due to clay accumulation in the casing shoe from the wellbore. As such, at steps S315, if plugging of the casing shoe is suspected, the casing shoe is inspected to verify that it is plugged. A determination that the casing shoe is plugged can be made by applying pressure inside the casing string and subsequently recognizing a buildup of pressure inside the casing string and a resulting restriction in performing cementing or pumping operations. For example, in one or more embodiments, to verify that the casing shoe is plugged, a surface pumping unit (e.g., a sucker rod pumping unit) can be activated to apply pressure inside casing string, where a buildup of said pressure inside the casing string and a resulting restriction in performing cementing or pumping operations is indicative of a plugged casing shoe. If the casing shoe is not plugged, then the cementing process continues and is completed in a conventional fashion.

However, if the casing shoe is plugged, then at step S320, the cementing tool 100/101 is activated. The cementing tool 100/101 tool is activated without removing the casing string from the well. As mentioned above, the cementing tool 100/101 can be attached to or adjacent to a float collar of the casing string or incorporated into the float collar of the casing string. If the casing shoe is plugged, the application of pressure in the casing at step S315 (e.g., via a surface pumping unit) activates the cementing tool 100/101, which causes the shear plugs 120 of the cementing tool to be released. The shear plugs 120 are caused to be released by trapping pressure at a desired value in the cementing tool 100/101. The amount of pressure needed to release the shear plugs 120 can only could happen if a plugging of the normal passage occurs (e.g., plugged casing shoe) and thus the needed resistance is present in the cementing tool 100/101. In other words, it is not possible to accidentally activate the cementing tool 100/101, as both the application of high pressure inside the casing string (e.g., from a surface pumping unit) and resistance (i.e., restriction in performing cementing or pumping operations that is indicative of a plugged casing shoe) are needed to provide the conditions for trapping pressure at the value needed to release the shear plugs 120. In one or more embodiments, an opening pressure of the cementing tool 100/101 upon activation does not exceed approximately 60% of a casing burst value. This ensures that the integrity of the casing is not affected by activation of the cementing tool. For example, in certain implementations, the opening pressure of the cementing tool upon activation does not exceed 5000 psi for that casing strings that have a casing burst value of more than approximately 8000 psi. However, it is noted that casing burst values are generally specific to the particular casing string and depend on the manufacturer of the casing string.

After activation of the cementing tool 100/101, at step S325 the cementing tool 100/101 creates one or more alternative passages for the cement for allowing the cement to pass through. As mentioned above, activation of the cementing tool 100/101 causes the shear plugs 120 of the cementing tools to be released by trapping pressure at a desired value. Release of the shear plugs 120 opens the plurality of ports 115, which provide alternative passages to allow the slurry of cement to bypass the plugged casing shoe so that the cementing of the casing string can continue. In other words, the opened ports 115 serve as the alternative passages for the cement slurry. The resistance of the shear plugs 120, and thus the amount of pressure needed to open the plurality of ports 115 is varied based on the size and type of casing string and the conditions of the wellbore, for example. However, as mentioned previously, the pressure for releasing the shear plugs 120 does not exceed 60% of the casing burst value.

For example, in one or more embodiments, the cementing tool 100 is connected to the casing string at a location just below the float collar, which is above (e.g., 80 feet or more above) the plugged area in the casing shoe. As such, after detecting a plugged casing shoe and upon activation of the cementing tool, the shear plugs 120 of the cementing tool are released, thereby opening the plurality of ports 115. This allows the cement slurry to pass through the ports. Due in part to its location well above the plugged area in the casing shoe, these alternative passages (ports 115) allow the cementing slurry to bypass the plugged area and the cementing process can continue without pulling the casing string back up to the surface of the wellbore.

At step S330, the cementing process of the casing string is completed using the alternative passages created by the cementing tool 100/101. At step S335, the method ends. In at least one embodiment, the casing shoe can be plugged before the cementing of the casing string begins (i.e., step S315 can occur be for step S310).

The cementing tool and the methods of the present application exhibit several advantages over previous methods for completing the cementing process of a casing string after the casing shoes has become plugged. For example, as mentioned previously, the cementing process of the present application can be completed after detection of a plugged casing shoe without removing the casing string from the wellbore. The ability to bypass the plugged casing shoe without removing the casing string from the wellbore saves money, repair time, and resources that were previously used to repair or replace the casing shoe after pulling the casing string to the surface. Additionally, the cementing tool 100/101 of the present application does not require an operator to run, and thus special personnel is not required to perform the method. The cementing tool 100/101 also cannot be accidently activated, and thus is only activated in instances in which the casing shoe has been plugged as releasing the shear plugs 120 needs high pressure forces which can only be applied when the casing string is plugged below a certain depth (e.g., a casing shoe plug). The cementing tool 100/101 can also be used at different locations along the casing string. In some embodiments, an unlimited number of cementing tools can be used in a casing string and activated in selective way depending on the required remedial casing cementing operations. Finally, the cementing tool 100/101 does not have to be closed ("deactivated") after use, which allows for the cementing process to be completed without further intervention at the location of the cementing tool 100/101.

Although much of the foregoing description has been directed to an apparatus and methods for cementing a casing string, the apparatus and methods disclosed herein can be similarly deployed and/or implemented in scenarios, situations, and settings far beyond the referenced scenarios. It should be further understood that any such implementation and/or deployment is within the scope of the methods described herein.

It is to be further understood that like numerals in the drawings represent like elements through the several figures, and that not all components and/or steps described and illustrated with reference to the figures are required for all embodiments or arrangements. Further, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "including," "comprising," or "having," "containing," "involving," and variations thereof herein, when used in this specification, specify the presence of stated features, integers, steps, operations, elements, and/or components, but do not preclude the presence or addition of one or more other features, integers, steps, operations, elements, components, and/or groups thereof.

It should be noted that use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Notably, the figures and examples above are not meant to limit the scope of the present disclosure to a single implementation, as other implementations are possible by way of interchange of some or all the described or illustrated elements. Moreover, where certain elements of the present disclosure can be partially or fully implemented using known components, only those portions of such known components that are necessary for an understanding of the present disclosure are described, and detailed descriptions of other portions of such known components are omitted so as not to obscure the disclosure. In the present specification, an implementation showing a singular component should not necessarily be limited to other implementations including a plurality of the same component, and vice-versa, unless explicitly stated otherwise herein. Moreover, applicants do not intend for any term in the specification or claims to be ascribed an uncommon or special meaning unless explicitly set forth as such. Further, the present disclosure encompasses present and future known equivalents to the known components referred to herein by way of illustration.

The foregoing description of the specific implementations will so fully reveal the general nature of the disclosure that others can, by applying knowledge within the skill of the relevant art(s), readily modify and/or adapt for various applications such specific implementations, without undue experimentation, without departing from the general concept of the present disclosure. Such adaptations and modifications are therefore intended to be within the meaning and range of equivalents of the disclosed implementations, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s). It is to be understood that dimensions discussed or shown are drawings are shown accordingly to one example and other dimensions can be used without departing from the disclosure.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, which is defined by the set of recitations in the following claims and by structures and functions or steps which are equivalent to these recitations.

What is claimed is:

1. A method for cementing a casing string in a well, the casing string comprising a casing shoe, a float collar, and a cementing tool, wherein the cementing tool comprises a plurality of ports arranged in a circumferential pattern on a surface of the cementing tool and a plurality of shear plugs each shaped to fit within one of the plurality of ports, the method comprising:

running the casing string with the cementing tool down into the well;

initiating a cementing process of the casing string in which cement is released down the casing string, wherein during the cementing process, the casing shoe becomes plugged; and activating the cementing tool, wherein the cementing tool is activated without removing the casing string from the well, and wherein activation of the cementing tool releases pressure trapped at a predetermined level in the cementing tool, thereby releasing the shear plugs from the ports and opening the ports to create alternative passages for the cement; and completing the cementing process of the casing string using the alternative passages created by the cementing tool, wherein the cementing tool further comprises:

a spring with a ball head, a concrete profile configured to hold the spring with the ball head, and a locking profile located above the spring with the ball head, and wherein the cementing tool is fabricated as part of the float collar of the casing string, and wherein the spring with the ball head, the concrete profile, and the locking profile are located above the plurality of ports.

2. The method of claim 1, wherein the step of activating the cementing tool comprises:

applying pressure in the casing string via a surface pumping unit, wherein the application of pressure causes a buildup of pressure in the cementing tool, which causes the shear plugs of the cementing tool to be released.

3. The method of claim 1, wherein the trapped pressure of the cementing tool upon activation does not exceed 60% of a casing burst value.

4. The method of claim 3, wherein the trapped pressure of the cementing tool upon activation does not exceed 5000 psi.

5. A method for cementing a casing string installed in a well, the casing string comprising a casing shoe, a float collar, and a cementing tool, wherein the cementing tool comprises a plurality of ports arranged in a circumferential pattern on a surface of the cementing tool and a plurality of shear plugs each shaped to fit within one of the plurality of ports, the method comprising:

initiating cementing of the casing string by pouring cement slurry into the casing string;

determining whether the casing shoe has become plugged;

if the casing shoe has been plugged, activating the cementing tool, wherein the cementing tool is activated without removing the casing string from the well, and wherein activation of the cementing tool releases pressure trapped at a predetermined level in the cementing tool, thereby releasing the shear plugs from the ports and opening the ports to create alternative passages for the cement; and completing the cementing process of the casing string using the alternative passages created by the cementing tool, wherein the cementing tool further comprises:

a spring with a ball head, a concrete profile configured to hold the spring with the ball head, and a locking profile located above the spring with the ball head, and wherein the cementing tool is fabricated as part of the float collar of the casing string, and wherein the spring with the ball head, the concrete profile, and the locking profile are located above the plurality of ports.

6. The method of claim 5, wherein an opening pressure of the cementing tool upon activation does not exceed 60% of a casing burst value.

7. The method of claim 5, wherein the step of activating the cementing tool comprises:

applying pressure in the casing string via a surface pumping unit, wherein the application of pressure causes a buildup of pressure in the cementing tool, which causes the shear plugs of the cementing tool to be released.

8. A cementing tool for completing cementing of a casing string when a casing shoe of the casing string becomes plugged, the cementing tool being generally cylindrical in shape, and the cementing tool comprising:

a top opening at a proximal end of the cementing tool, wherein the top opening has a threaded portion on an inner or outer surface of the proximal end;

a bottom opening at a distal end of the cementing tool, wherein the bottom opening has a threaded portion on an inner or outer surface of the distal end, wherein at least one of the threaded portions of the top opening and the threaded portion of the bottom opening is configured to securely attach to the casing string;

a plurality of ports arranged in a circumferential pattern on the cementing tool; and a plurality of shear plugs each shaped to fit within one of the plurality of ports, wherein the shear plugs are configured to release from the ports upon activation of the cementing tool, thereby creating alternative passages for cement to pass to complete the cementing of the casing string, a spring with a ball head;

a concrete profile configured to hold the spring with the ball head; and a locking profile located above the spring with the ball head, wherein the cementing tool is fabricated as part of a float collar of the casing string, and wherein the spring with the ball head, the concrete profile, and the locking profile are located between the top opening and the bottom opening and above the plurality of ports.

9. The cementing tool of claim 8, wherein the threaded portion of the top opening is on the inner surface of the proximal end and wherein the threaded portion the bottom opening on the outer surface of the distal end.

10. The cementing tool of claim 8, wherein threaded portion of the top opening and the threaded portion of the bottom opening are manufactured from drillable material.

11. The cementing tool of claim 10, wherein the drillable material is brass or copper.

12. The cementing tool of claim 8, wherein the shear plugs comprise an aluminum and copper alloy.

13. The cementing tool of claim 8, wherein the spring with the ball head is configured to prevents flowback of the cement slurry during cementing of the casing string.

* * * * *